US007884774B2

(12) United States Patent
Huang et al.

(10) Patent No.: US 7,884,774 B2
(45) Date of Patent: Feb. 8, 2011

(54) PLANAR ANTENNA

(75) Inventors: Chi-Cheng Huang, Taoyuan County (TW); Chia-Bin Yang, Taoyuan County (TW)

(73) Assignee: Delta Networks, Inc., Taoyuan County (TW)

( * ) Notice: Subject to any disclaimer, the term of this patent is extended or adjusted under 35 U.S.C. 154(b) by 101 days.

(21) Appl. No.: 11/945,711

(22) Filed: Nov. 27, 2007

(65) Prior Publication Data

US 2008/0158068 A1 Jul. 3, 2008

(30) Foreign Application Priority Data

Jan. 2, 2007 (TW) ..... 96100122

(51) Int. Cl.
*H01Q 9/28* (2006.01)

(52) U.S. Cl. ..... 343/795; 343/700 MS

(58) Field of Classification Search ..... 343/700 MS, 343/895, 795, 803, 817–821, 725–727
See application file for complete search history.

(56) References Cited

U.S. PATENT DOCUMENTS 6,765,539 B1 * 7/2004 Wang et al. ..... 343/795
6,847,329 B2 * 1/2005 Ikegaya et al. ..... 343/702
6,961,028 B2 * 11/2005 Joy et al. ..... 343/895
6,963,310 B2 * 11/2005 Horita et al. ..... 343/702
7,042,415 B2 * 5/2006 Cheng ..... 343/795
7,071,877 B2 * 7/2006 Okado ..... 343/700 MS

* cited by examiner

*Primary Examiner*—James H. Cho
*Assistant Examiner*—Christopher Lo
(74) *Attorney, Agent, or Firm*—Volpe and Koenig, PC

(57) ABSTRACT

The present invention provides a wireless transmit/receive unit, comprising a feeding connecting line, a first radiating line, a second radiating line, a third radiating line and a fourth radiating line, wherein the third radiating line is longer than the first radiating line and the first radiating line is longer than the second radiating line that provides different current paths for getting a broader bandwidth. The first, second and third radiating lines are connected parallel for enhancing an antenna pattern being perpendicular thereto, and form a series capacity between the first and the third radiating lines. The fourth radiating line vertically connects between the third radiating line and a grounding line for forming a grounding capacity. The printed antenna can be reduced in size by the effect of the two capacities. The wireless transmit/receive unit can provide a better isolation with others by the direction enforced pattern and the reduced size.

9 Claims, 9 Drawing Sheets

PLANAR ANTENNA

FIELD OF THE INVENTION

The present invention relates to a planar antenna, and more particular to the planar antenna used for the multiple antenna transmitting devices.

BACKGROUND OF THE INVENTION

The conventional wireless transmitting deices have to mount antenna in the front end thereof for transmitting and receiving. In general wireless transmitting deices, the use of the front antennas are depended on the inside space, the features and the cost thereof. So far, the antennas used on the wireless transmitting devices can be sorted by the band width, such as the single band, the dual band, the multiple band and the wild band antenna . . . etc. Otherwise, the antennas can also be divided to two groups by the material, one is chip antenna and the other is printed antenna; wherein the chip antenna has the features of the smaller area, the high cost and the narrower band width. The printed antenna can further be sorted by the structure, such as the monopole, the dipole, the PIFA and the circular antenna, wherein the features thereof are the bigger area, the low cost and the broad band width which are opposite to the chip antenna.

Recently, the configuring strategies of the antennas in the wireless transmitting devices using the multiple antennas operation mode are putting the antennas in the limited space as much as possible and remaining the low cost, the wild band and the well isolation between the antennas. However, the existing chip antennas and printed antennas are all not able to satisfy the requirements of the multiple antennas operation mode, for example, the chip antennas have the advantages of the small area and the good isolation, but also have the defects of the narrow band and the high cost; and the printed antennas have the advantages of the wild band and the low cost, but also have the defects of the big area and bad isolation.

The most presently procession methods use the software in the data processing device connecting to the wireless transmitting device, for example the personal computer, to analyze and distinguish the data for dealing the data feedback problem. However, such processing methods do not really solve the problem, i.e. the data feedback is still existing, and just no bother through the methods, and cost for the software is also high.

As above-mentioned, in order to maintain smaller size, have better isolation and reduce the cost of the antenna, a plane antenna is provided in the present invention.

SUMMARY OF THE INVENTION

In accordance with a main aspect of the present invention, a wireless transmitting/receiving unit is provided, which can reduce the using area, increase the band wideness and increase the isolation between the antennas by enhancing the single direction radiation field. The wireless transmitting/receiving unit comprises a first radiating segment transmitting/receiving a first directional radio wave perpendicular thereto; a second radiating segment connected to the first radiating segment for transmitting/receiving the first directional radio wave; and a third radiating segment connected to the second radiating segment for transmitting/receiving the first directional radio wave, wherein the length of the first radiating segment is longer than that of the second radiating segment, and the length of the third radiating segment is longer than that of the first radiating segment.

According to the wireless transmitting/receiving unit above, further comprising a feeding segment perpendicularly connected to the first radiating segment for transmitting a feeding signal.

According to the wireless transmitting/receiving unit above, wherein the first, the second and the third radiating segments are parallel to one another.

According to the wireless transmitting/receiving unit above, wherein the second radiating segment provides various current pathways and a first gap between the first and the third radiating segments, the variety current pathways is used for increasing a transmitting/receiving band width, and the first gap is used for generating a serial capacitance to form a relatively low frequency so as to reduce a required length of the radiating segments.

According to the wireless transmitting/receiving unit above, further comprising a fourth radiating segment perpendicularly connected to the third radiating segment and a grounding segment for transmitting/receiving a second directional radio wave and providing a second gap therebetween, wherein the second directional radio wave is perpendicular to the fourth radiating segment, the second gap is used for generating a grounding capacitance to form a relatively low frequency so as to reduce a required length of the radiating segments.

Another aspect of the present invention is to provide a multi-input/multi-output antenna comprising a circuit board, comprising: at least one transmitting/receiving unit set having two identical transmitting/receiving units symmetrically configured on both sides of the circuit board, wherein each transmitting/receiving unit comprises: a first radiating segment transmitting/receiving a first directional radio wave perpendicular thereto; a second radiating segment connected to the first radiating segment for transmitting/receiving the first directional radio wave; and a third radiating segment connected to the second radiating segment for transmitting/receiving the first directional radio wave, wherein the length of the first radiating segment is longer than that of the second radiating segment, and the length of the third radiating segment is longer than that of the first radiating segment.

According to the multi-input/multi-output antenna above, wherein the circuit board is a FR-4 board.

According to the multi-input/multi-output antenna above, further comprising an omni-directional transmitting/receiving unit configured on a front end of the circuit board.

According to the multi-input/multi-output antenna above, wherein a number of the transmitting/receiving units is even.

According to the multi-input/multi-output antenna above, wherein the first, the second and the third radiating segments are parallel to one another.

According to the multi-input/multi-output antenna above, further comprising a feeding segment perpendicularly connected to the first radiating segment for transmitting a feeding signal.

According to the multi-input/multi-output antenna above, wherein the second radiating segment provides various current pathways and a first gap between the first and the third radiating segments, the current pathways are used for increasing a transmitting/receiving band width, and the first gap is used for generating a serial capacitance to form a relatively low frequency so as to reduce a required length of the radiating segments.

According to the multi-input/multi-output antenna above, further comprising a fourth radiating segment perpendicularly connected to the third radiating segment and a grounding segment for transmitting/receiving a second directional radio wave and providing a second gap therebetween, wherein the second directional radio wave is perpendicular to the fourth radiating segment, and the second gap is used for generating a grounding capacitance to form a relatively low frequency so as to reduce a required length of the radiating segments.

Another aspect of the present invention is to provide a wireless transmission device comprising the multi-input/multi-output antenna as above description.

Another aspect of the prevent invention is to provide a directional antenna. The directional antenna comprises a first radiating segment having a first and a second surfaces for transmitting/receiving a first directional radio wave perpendicular thereto; a second radiating segment having a third and a fourth surfaces for transmitting/receiving the first directional radio wave; and a connecting device connected between the second surface of the first radiating segment and the third surface of the second radiating segment, wherein the length of the second radiating segment is longer than that of the first radiating segment.

According to the directional antenna above, further comprising a feeding segment perpendicularly connected to the first radiating segment for transmitting a feeding signal.

According to the directional antenna above, wherein the first, the second, the third and the fourth surfaces radiating segments are parallel to one another.

According to the directional antenna above, wherein the connecting device is a third radiating segment having a length shorter than that of the first radiating segment.

According to the directional antenna above, wherein the third radiating segment provides various current pathways and a first gap between the first and the second radiating segments, the current pathways are used for increasing a transmitting/receiving band width, and the first gap is used for generating a serial capacitance to form a relatively low frequency so as to reduce a required length of the radiating segments.

According to the directional antenna above, further comprising a fourth radiating segment perpendicularly connected to the second radiating segment and a grounding line for transmitting/receiving a second directional radio wave and providing a second gap therebetween, wherein the second directional radio wave is perpendicular to the fourth radiating segment, and the second gap is used for generating a grounding capacitance to form a relatively low frequency so as to reduce a required length of the radiating segments.

The above contents and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
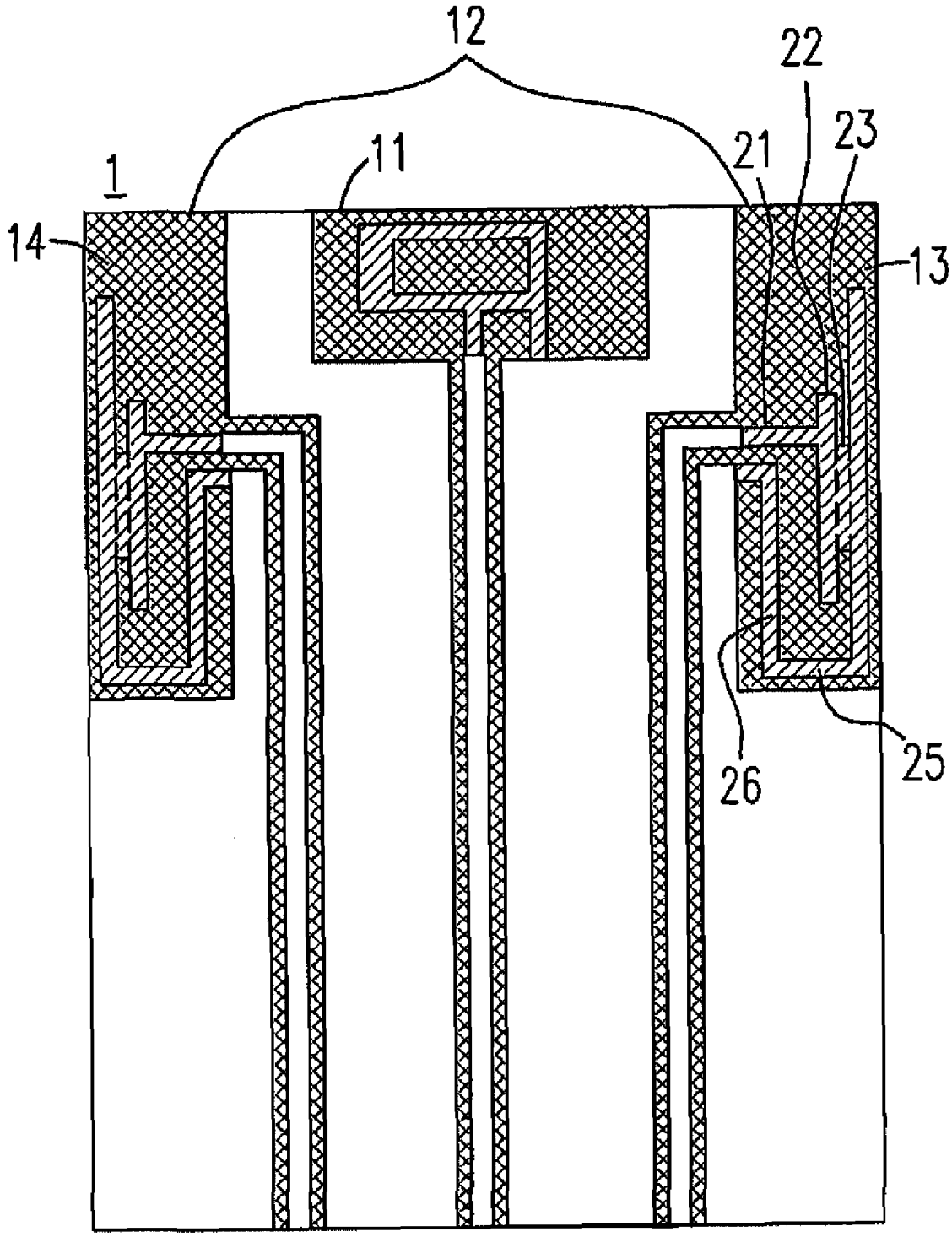
FIG. 1 is a diagram showing the embodiment of the present invention, the plane antenna.

Please refer to FIG. 1, which is the diagram showing the embodiment of the present invention, the plane antenna, which is applying to a wireless network card with three plane antennas. The components of the wireless network card comprise a rectangular circuit substrate 1 made by the fiberglass material, FR4, which is dielectric constant is between 4.2 to 4.7. The rectangular circuit substrate 1 has a front end for transmitting/receiving signal and a back end being an interface for connecting to the circuit. There are an omni-directional antenna 11 and a side antenna set 12, which are configured symmetrically in both sides of the omni-directional antenna 11. The omni-directional antenna 11 can transmit/receive the resonance wave in the omni-direction. The side antenna set 12 has a first side antenna 13 and a second side antenna with complete the same structure. The components of each side antenna 13, 14 comprise a feeding segment 21, a first radiating segment 22, a second radiating segment 23, a third radiating segment 24, a fourth radiating segment 25 and a ground segment 26, where the function of each radiating segment transmits/receives a resonance wave perpendicular thereto, the feeding segment 21 feeds the desired signal from the circuit and the ground segment 26 connects the ground.

Figure 2:
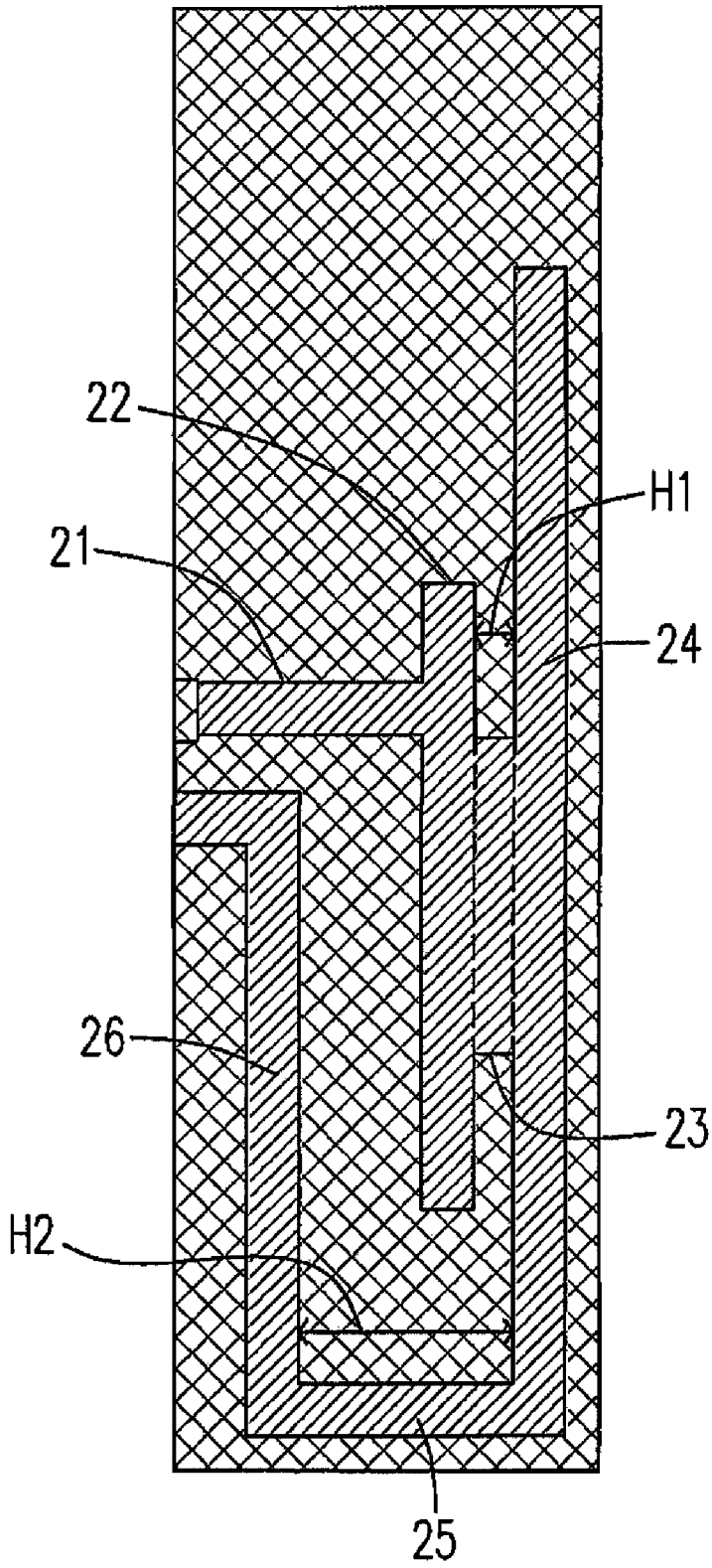
FIG. 2 is a enlarged diagram showing the structure of the side antenna of the FIG. 1.

Please refer to FIG. 2, which is the enlarged diagram showing the structure of the side antenna of the side antennas 13, 14, in which the first, second and third radiating segments are parallel and connected to one another. Besides, in accordance with the design of the present invention, the length of the third radiating segment 24 is longer than that of the first radiating segment 23, and the first radiating segment is longer than that of the second radiating segment 24. Since the current flows along the metal edge, the different lengths design above for the radiating segments can generate two different current pathways, one is longer and the other is shorter. The longer current pathway generates a low frequency resonance wave and the shorter current pathway generates a high frequency resonance wave. Such design can obtain a boarder resonance frequency region resulted by adding up the low frequency from the long current pathway and the high frequency from the short current pathway. In addition, the shortest second radiating segment 23 further generates a first gap H1 between the first and third radiating segments 22, 24, which can generate a serial capacitance between the first and third radiating segments 22, 24. Furthermore, the fourth radiating segment 25 is perpendicularly connected between the third radiating segment 24 and the ground segment 26 and generates a second gap H2 therebetween, which generates a ground capacitance therebetween.

Following the formulas below, which introduce the relationship of the resonance wave length of the antenna $\lambda a$ and the resonance wave length received thereby $\lambda_0$ under the specific medium and resonance wave frequency.

$C=\lambda \cdot f$($C=3\cdot 10^8$ m/s, the velocity of wave=the velocity of light)

The resonance wave frequency=2.45 GHz, $\lambda_0=3\cdot 10^8/2.45\cdot 10^9=12.24$ cm (1 G=$10^9$)

$\lambda a=\lambda_0/\sqrt{\in eff}$ ($\in_r$ *eff* is 0.75+0.25$\in r$, because the field distribution is free space:*FR*4≈75%:25%)

For the general dipolar antenna, because the length of the antenna is around ½λa, the both ends will form a broken circuit that generates a standing wave for achieving the resonance. Therefore, the length of the antenna is decided by $\frac{1}{2}\lambda a \approx \frac{1}{4}\lambda_0$.

Moreover, in the present invention, the two capacitances described above, the serial and the ground capacitances are used to increase the capacitance. Following the formulas below, which introduce the relationship between the capacitance and the length of the antenna.

$$V_p = \frac{1}{\sqrt{LC}}$$

$$V_p = f \cdot \lambda$$

$V_p$ is the phase velocity, the L is inductance, the C is capacitance, $f$ is the frequency and λ is the length of wave.

The phase velocity is decreased resulted by the increasing of the capacitance. And then, under the same resonance frequency, the lower phase velocity will generate shorter wave length. Therefore, the antenna can receive the same frequency wave by a shorter radiating segment with the capacitance.

Accordingly, the present invention uses the connecting relation to increase the capacitance for reduce the requirement of the antenna length. On the other hand, it means that the same frequency resonance wave can be received by the smaller antenna with the capacitance effect. Therefore, when such antenna is configured, it needs shorter radiating segments to obtain the desired resonance frequency, i.e. it needs smaller area.

Figure 3:
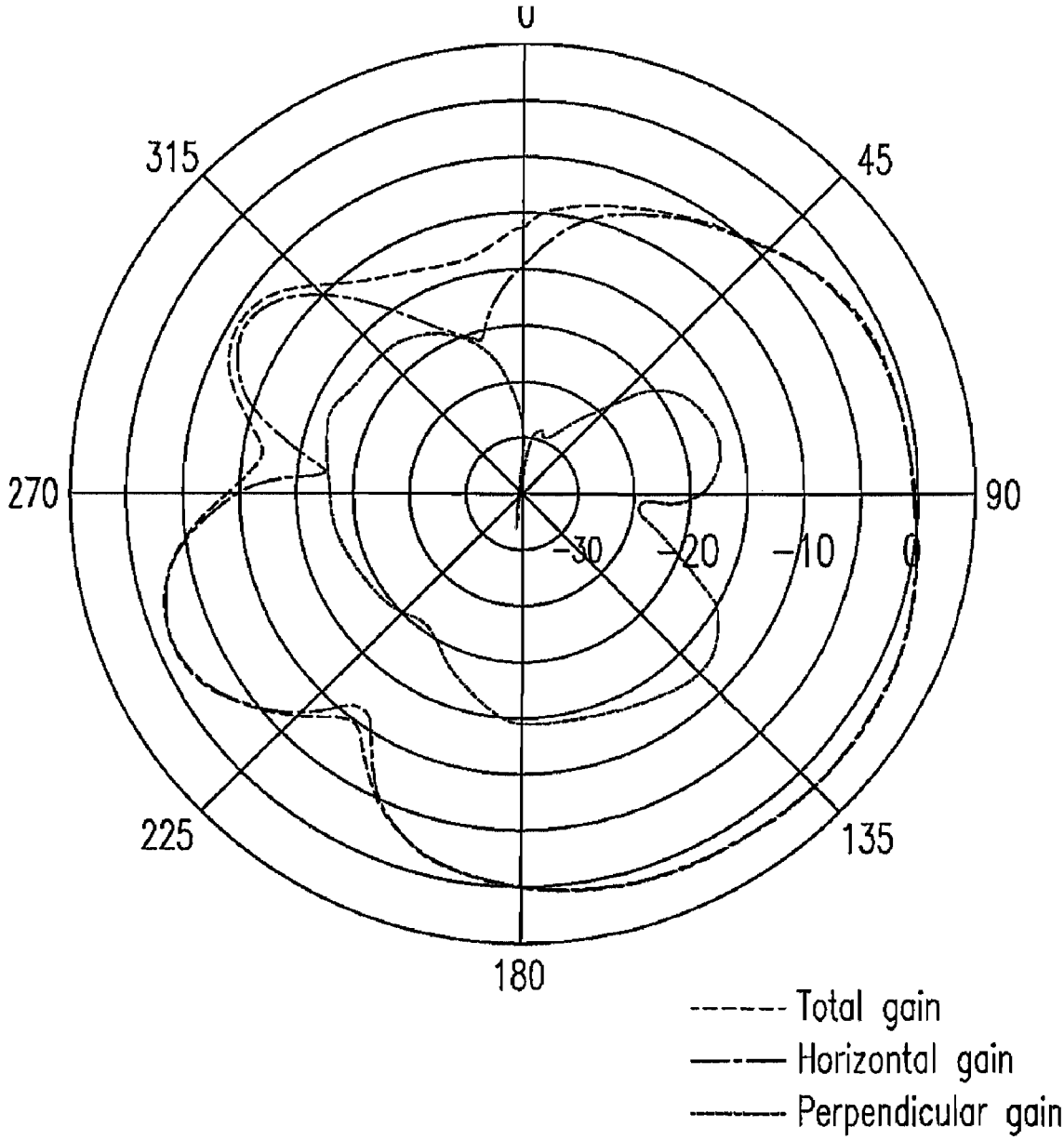
FIG. 3 is a diagram showing the testing result of the resonance wave field of the side antenna 13, 14.

Please refer to FIG. 3, which is a diagram showing the testing result of the resonance wave field of the side antenna 13, 14. First, the side antenna 13, 14 is used as a receiving antenna and is horizontally spun for receiving the horizontal polarized signals from a fixed horn antenna and obtaining a cure diagram of the horizontal polarized gain. Second, the horn antenna is perpendicularly spun and releases the perpendicular polarized signals. The side antenna 13, 14 is horizontally spun for receiving the perpendicular polarized signals and obtaining a cure diagram of the perpendicular polarized gain. Add up the horizontal polarized gain and the perpendicular polarized gain, the total gain will be obtained, which is also the field of the side antenna 13, 14. Since the present invention overlaps the first, second and third radiating segments 22, 23, 24 parallely, the wave field thereof is enhanced and intending to the direction perpendicular thereto. Therefore, the side antenna 13, 14 is a directional antenna.

Please refer to FIG. 1 again, according to the features described above, the first side antenna 13 and the second side antenna 14 of the present invention are disposed on the both two sides of the X axle of the circuit substrate 1 and the disposition of the first, second and third radiating segments 22, 23, 24, so the antenna fields are intending to the both two sides of the circuit substrate 1. Adding the reduced area, the overlapping potions between the omni-directional antenna 11 and the first and the second side antennas 13, 14 are decreased both in field and space. Therefore, the isolations between the antennas are increased accordingly.

Figure 4:
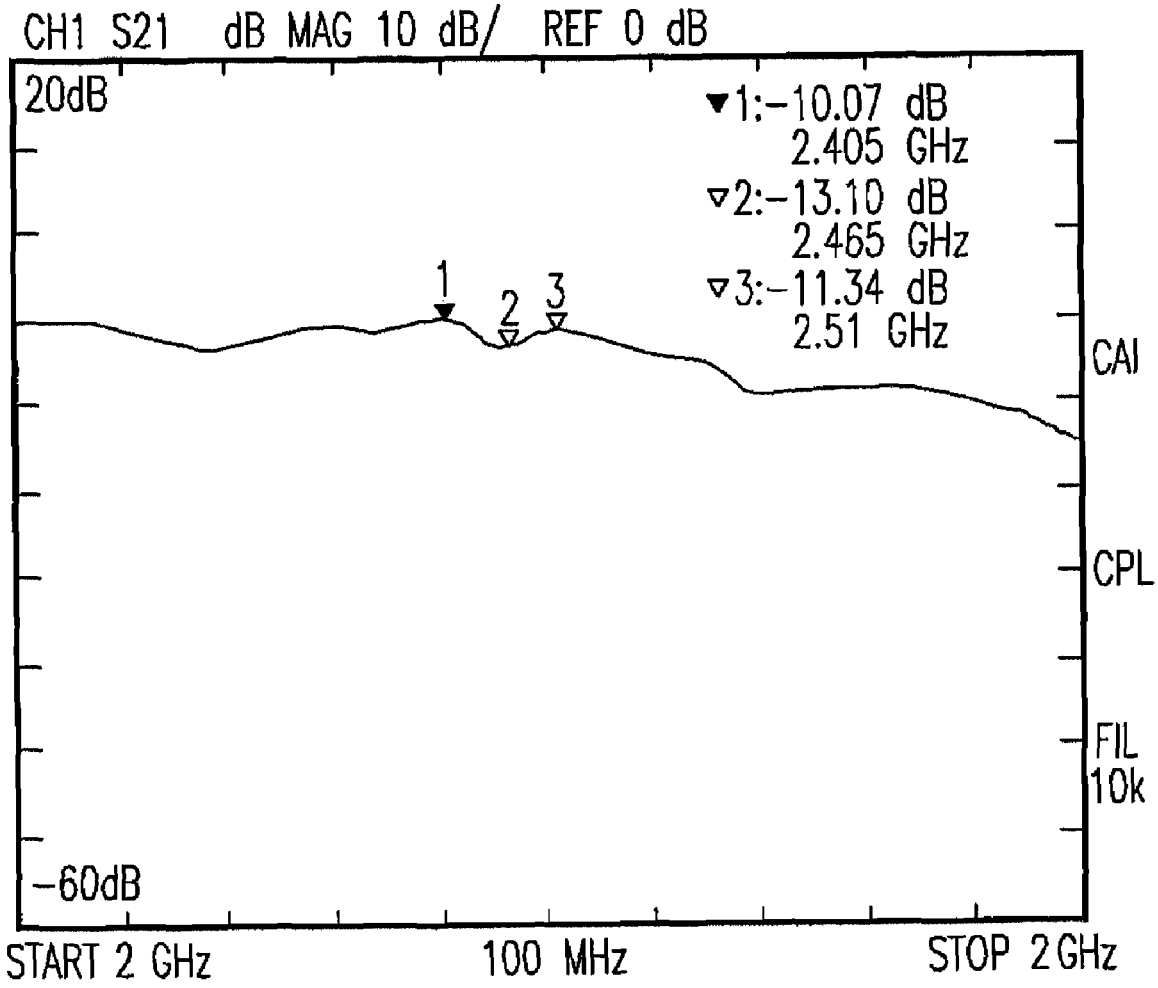
FIG. 4 is a curve diagram showing the isolation testing result between the first side antenna 13 and the omni-directional antenna 11 ($S_{0-1}$)
Figure 5:
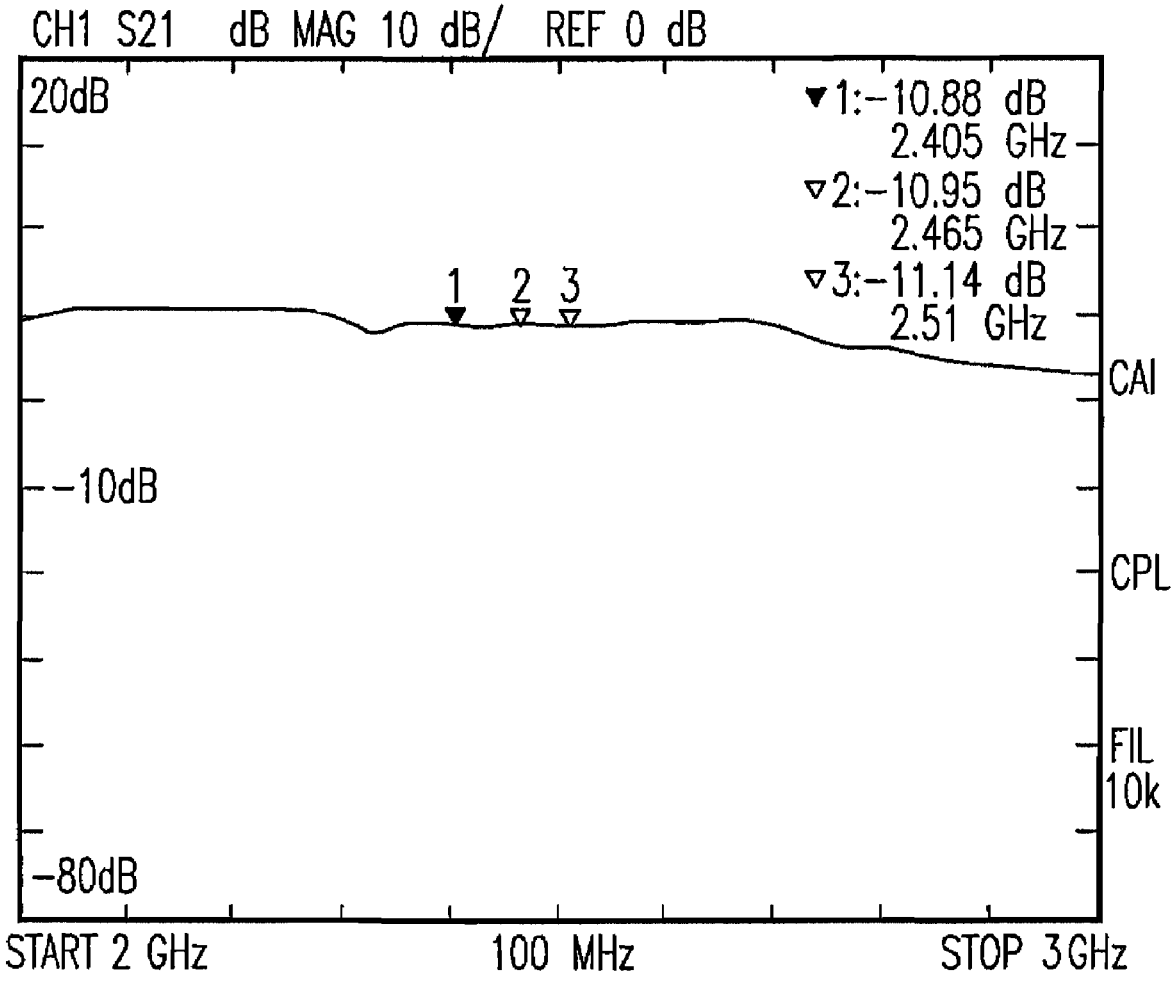
FIG. 5 is a curve diagram showing the isolation testing result between the second side antenna 14 and the omni-directional antenna 11 ($S_{0-2}$)
Figure 6:
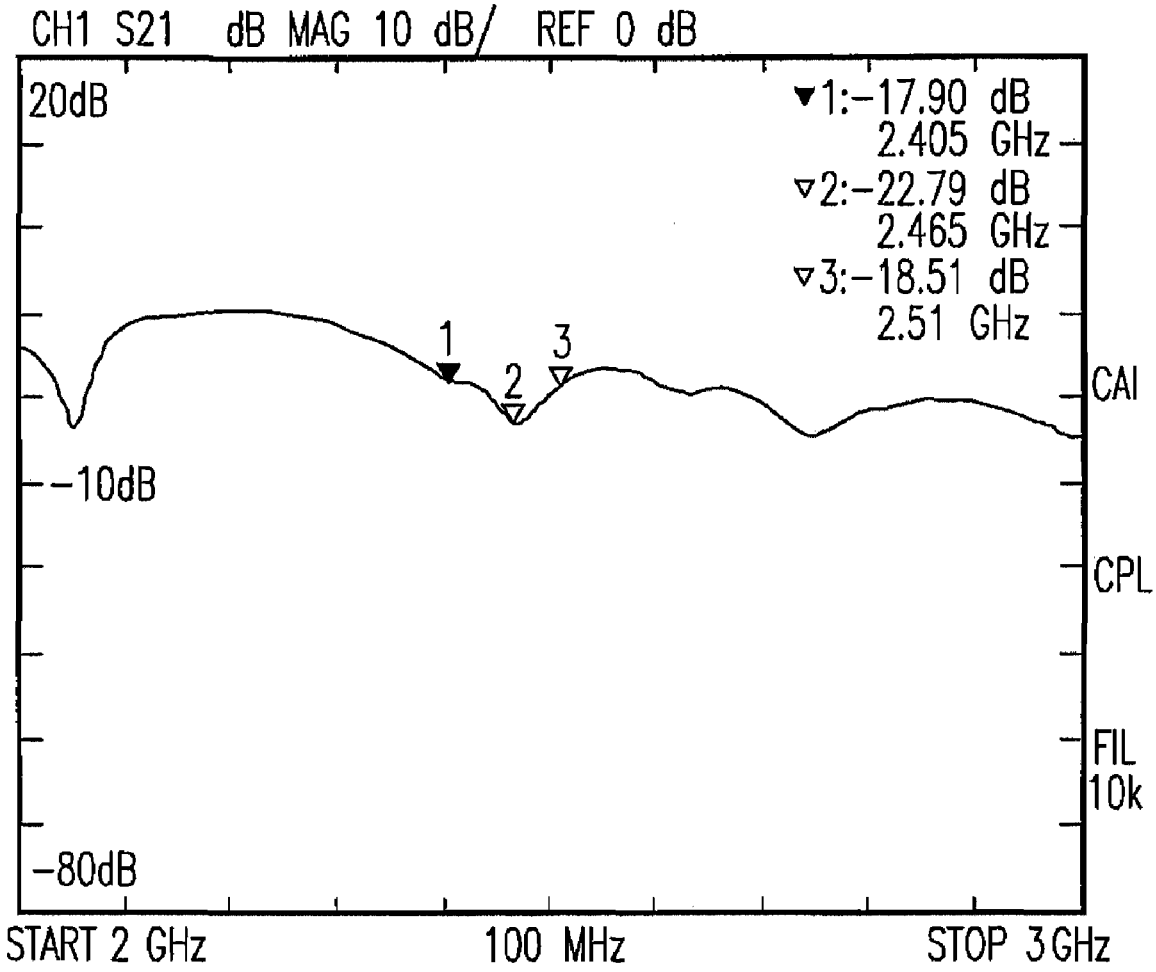
FIG. 6 is a curve diagram showing the isolation testing result between the first side antenna 13 and the second side antenna 14 ($S_{1-2}$)

Please refer to FIG. 4, which is the curve diagram showing the isolation testing result between the first side antenna 13 and the omni-directional antenna 11 ($S_{0-1}$), and under the frequency region 2.4 GHz~2.5 GHz, the isolation therebetween ($S_{0-1}$) is around −10.01 dB~−13.1 dB. FIG. 5 is the curve diagram showing the isolation testing result between the second side antenna 14 and the omni-directional antenna 11 ($S_{0-2}$), and under the frequency region 2.4 GHz~2.5 GHz, the isolation therebetween ($S_{0-2}$) is around −10.8 dB~−11.1 dB. FIG. 6 is the curve diagram showing the isolation testing result between the first side antenna 13 and the second side antenna 14 ($S_{1-2}$), and under the frequency region 2.4 GHz~2.5 GHz, the isolation therebetween ($S_{0-1}$) is around −17.9 dB~−22.7 dB. Accordingly, the isolations of the present invention are much better than the conventional mono-polar antenna, around −6~−8 dB, used in the multi-antenna plane antenna.

Figure 7:
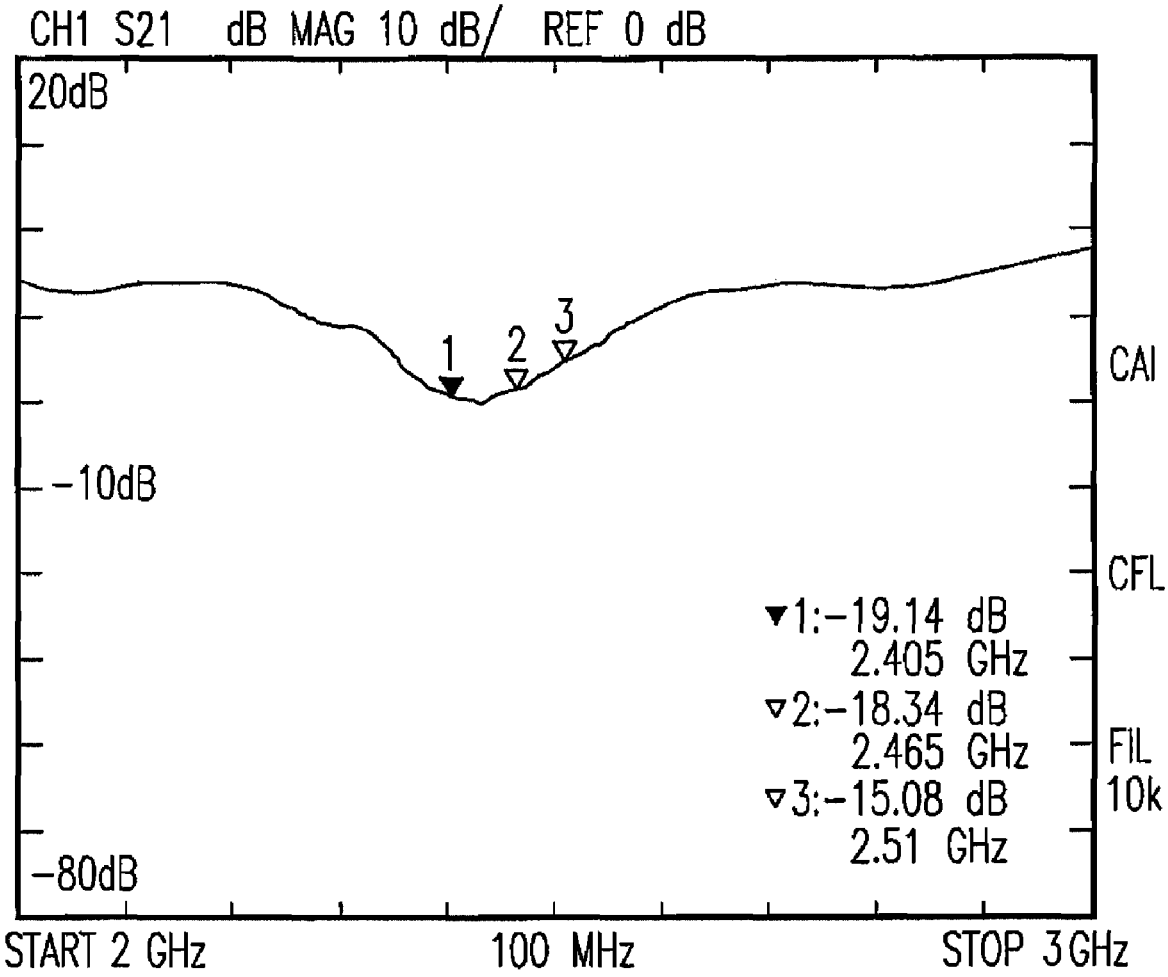
FIG. 7 is a diagram showing the return loss testing result of the omni-directional antenna 11 ($S_{0-0}$)
Figure 8:
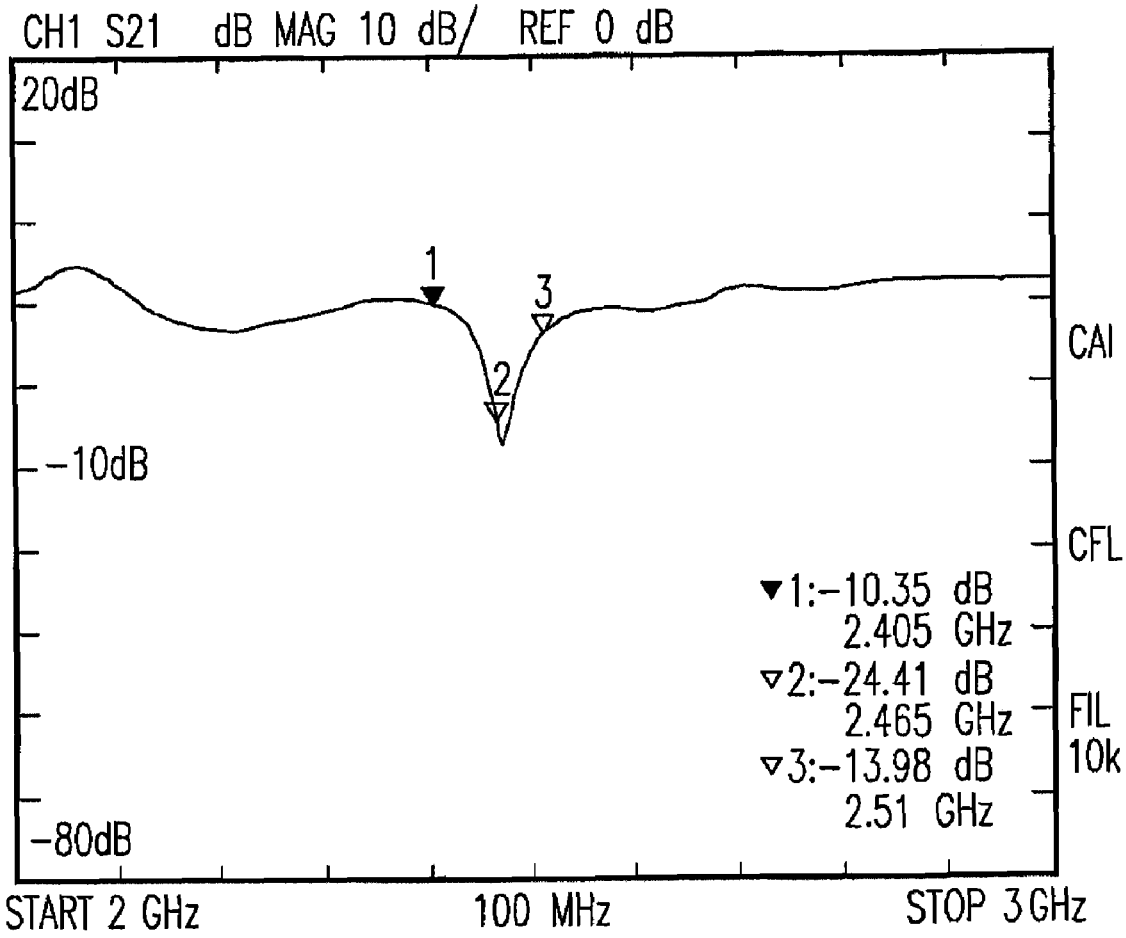
FIG. 8 is a diagram showing the return loss testing result of the first side antenna 13 ($S_{1-1}$)
Figure 9:
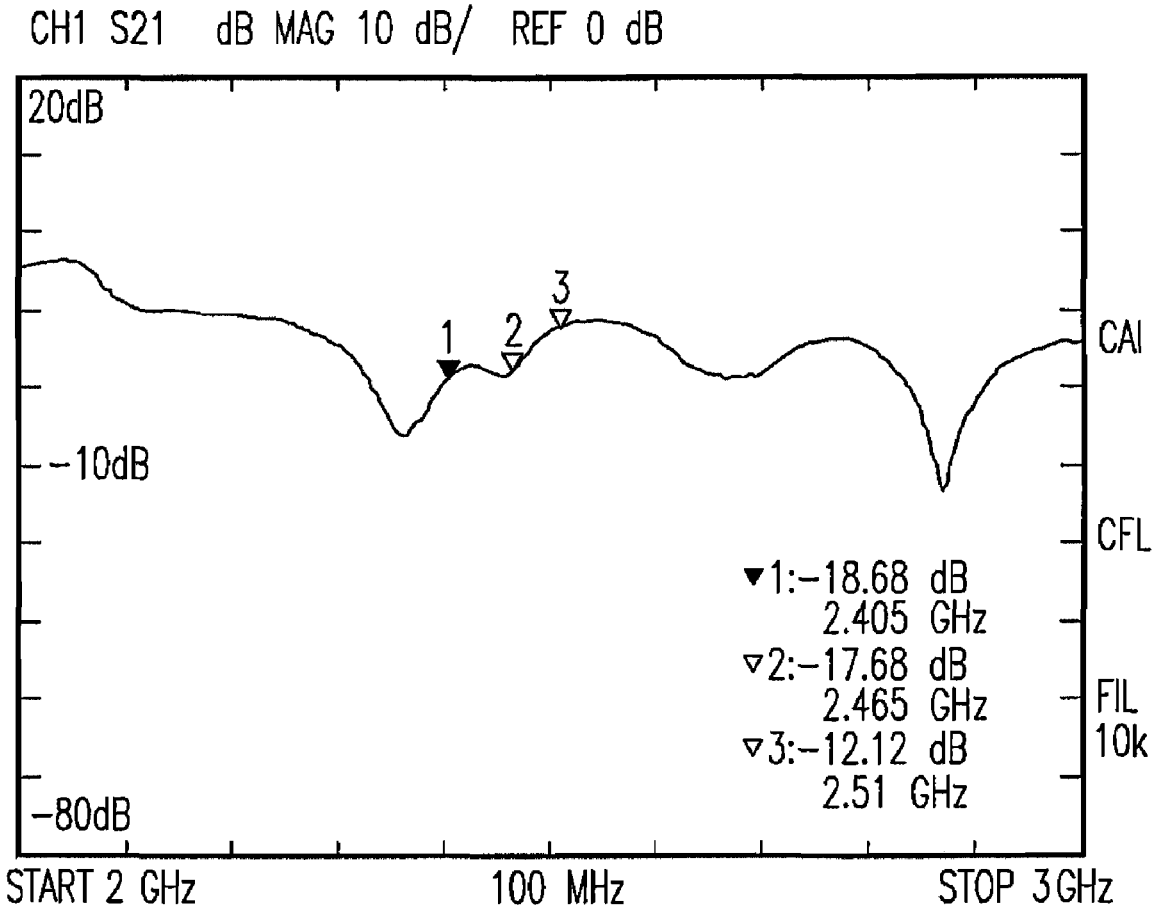
FIG. 9 is a diagram showing the return loss testing result of the second side antenna 14 ($S_{2-2}$).

Please refer to FIG. 7, which is a diagram showing the return loss testing result of the omni-directional antenna 11 ($S_{0-0}$). When the return loss is smaller than −10 dB, the frequency is available for the antenna. According to FIG. 7, the return loss of the frequency region 2.3 GHz~2.58 GHz in the omni-directional antenna 11 is smaller than −10 dB, i.e. the available frequency region of the omni-directional antenna 11 is 2.3 GHz~2.58 GHz. FIG. 8 is the diagram showing the return loss testing result of the first side antenna 13 ($S_{1-1}$), and the available frequency region thereof is 2.38 GHz~2.75 GHz. FIG. 9 is the diagram showing the return loss testing result of the second side antenna 14 ($S_{2-2}$), and the available frequency region thereof is 2.2 GHz~3 GHz. According to the testing result above, the available band widths of the present plane antenna are certainly increased.

While the application has been described in terms of what are presently considered to be the most practical and preferred embodiments, it is to be understood that the application need not be limited to the disclosed embodiment. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present application which is defined by the appended claims.

What is claimed is:

1. A multi-input/multi-output antenna, comprising:

a circuit board, comprising:

at least one transmitting/receiving unit set having two identical transmitting/receiving units symmetrically configured on both sides of the circuit board, wherein each transmitting/receiving unit comprises:

a first radiating segment transmitting/receiving a first directional radio wave perpendicular thereto;

a second radiating segment connected to the first radiating segment for transmitting/receiving the first directional radio wave; and a third radiating segment connected to the second radiating segment for transmitting/receiving the first directional radio wave, wherein the length of the first radiating segment is longer than that of the second radiating segment, and the length of the third radiating segment is longer than that of the first radiating segment.

2. The multi-input/multi-output antenna claimed as claim 1, wherein the circuit board is a FR-4 board.

3. The multi-input/multi-output antenna claimed as claim 1, further comprising an omni-directional transmitting/receiving unit configured on a front end of the circuit board.

4. The multi-input/multi-output antenna claimed as claim 1, wherein a number of the transmitting/receiving units is even.

5. The multi-input/multi-output antenna claimed as claim 1, wherein the first, the second and the third radiating segments are parallel to one another.

6. The multi-input/multi-output antenna claimed as claim 1, further comprising a feeding segment perpendicularly connected to the first radiating segment for transmitting a feeding signal.

7. The multi-input/multi-output antenna claimed as claim 1, wherein the second radiating segment provides various current pathways and a first gap between the first and the third radiating segments, the current pathways are used for increasing a transmitting/receiving band width, and the first gap is used for generating a serial capacitance to form a relatively low frequency so as to reduce a required length of the radiating segments.

8. The multi-input/multi-output antenna claimed as claim 1, further comprising a fourth radiating segment perpendicularly connected to the third radiating segment and a grounding segment for transmitting/receiving a second directional radio wave and providing a second gap therebetween, wherein the second directional radio wave is perpendicular to the fourth radiating segment, and the second gap is used for generating a grounding capacitance to form a relatively low frequency so as to reduce a required length of the radiating segments.

9. The wireless transmission device comprising the multi-input/multi-output antenna as claimed in claims 1.

* * * * *